US006000965A

United States Patent [19]

Hsiao et al.

[11] Patent Number: 6,000,965

[45] Date of Patent: Dec. 14, 1999

[54] RETAINING APPARATUS FOR A CONNECTOR

[75] Inventors: Yu-San Hsiao; Li-Ming Po; Yu-Chien Hsiao, all of Tu-Chen, Taiwan

[73] Assignee: Hon Hai Precision Ind. Co., Ltd., Taipei Hsien, Taiwan

[21] Appl. No.: 08/950,227

[22] Filed: Oct. 14, 1997

[30] Foreign Application Priority Data

Oct. 12, 1996 [TW] Taiwan ..... 85215701

[51] Int. Cl.[6] ..... H01R 13/60

[52] U.S. Cl. ..... 439/567; 439/565; 439/573; 439/885

[58] Field of Search ..... 439/567, 571, 439/573, 564, 565, 733.1, 885

[56] References Cited

U.S. PATENT DOCUMENTS 4,776,651 10/1988 Paulo ..... 439/885
5,171,165 12/1992 Hwang ..... 439/571
5,228,870 7/1993 Gorenc et al. ..... 439/571
5,238,413 8/1993 McCaffrey et al. ..... 439/571
5,259,793 11/1993 Yamada et al. ..... 439/751
5,479,257 12/1995 Cachina et al. ..... 439/571

*Primary Examiner*—Paula Bradley
*Assistant Examiner*—Katrina Davis

[57] ABSTRACT

A retaining device (200) for fixing a connector (10) on a printed circuit board includes a main body (210) including a first edge (212) and a second edge (214) substantially perpendicular to the first edge (212). A first engaging portion (220) is projected from the first edge (212) of the main body (210) and firmly fixed in the connector (10) via barbs (2202). A guiding and positioning portion (230) is projected from the main body (210) for guiding and positioning the main body (210) in the connector (10). A second engaging portion (240) is extended from the second edge (214) of the main body (10) and it is engaged to the printed circuit board.

9 Claims, 4 Drawing Sheets

RETAINING APPARATUS FOR A CONNECTOR

BACKGROUND OF THE INVENTION

1. Field of the Invention

The invention relates to a retaining apparatus for a connector, particularly to a retainer which is easily configured and quickly positioned for fixing a connector on a printed circuit board of a personal computer.

2. The Prior Art

A conventional retaining device of a connector comprises at least a connector engaging portion which includes a barb for fixing itself to the connector and a board engaging portion which includes a hook or the like for fixing itself to a printed circuit board, thereby retaining the connector on the printed circuit board. However, most of the retaining devices of the connectors have the following drawbacks:

1. The retaining device of the conventional connectors usually have very complicated structures thus inducing difficulties in manufacturing and assembling.

2. The relatively engaging direction between the retaining device and the connector is the same as that of the insertion (or withdrawal) direction of the connector into (or from) the printed circuit board. With this structural relationship between the conventional retaining device and the connector, the related engaging portions of each of the retaining device and the connector is apt to be worn out or broken due to long time of insertion or withdrawal of the connector into or from the circuit board.

There are some advanced retaining devices of the connectors are configured in such a way that the relatively engaging direction between the retaining device and the connector is different from that of the insertion (or withdrawal) direction of the connector into (from) the printed circuit board. However, these kind of advanced retaining devices cost high due to the generated machining waste during manufacturing. Actually, the function of these kind of retaining devices does not totally satisfy the users. For example, a user feels cumbersome due to alignment difficulty when more than one these advanced retaining devices are required to be concurrently connected to a same connector. Moreover, most of the printed circuit boards have specific through-holes or soldering pads with corresponding positions and sizes thereof for mating the board engaging portion of the retaining device (for example one or several hooks or soldering mounting ears), and sometimes the hook of one of the retaining devices will have to be enforceably declined (offset) so as to fit in the through-hole due to the inconsistency of the retaining devices connected to the connector. The conventional retaining devices may be referred to Taiwan Patents with the application numbers of 80202099, 81207106, 82204413, 82206344, 82216079, 83207936, and 84101384.

Therefore, the present invention especially focuses on providing a new structure of the connector engaging portion to prevent the aforementioned drawbacks of the conventional retaining devices.

SUMMARY OF THE INVENTION

The primary purpose of the present invention is to provide a new retaining device having a connector engaging means which includes a guiding portion for suitably guiding the connector engaging means into the connector via a guiding slot defined in the connector. With the guiding portion of the connector engaging means, the retaining device may be engaged to the connector quickly and easily.

Another purpose of the present invention is to provide a new retaining device having a connector engaging means shaped as an elongate body for firmly reception in a corresponding chamber defined in the connector, thus increasing the solid engagement therebetween.

A further purpose of the present invention is to provide a new retaining device having a connector engaging means which is engaged with the connector in a substantially perpendicular direction with respect to a withdrawal direction of the connector from the printed circuit board in such a way that even when the connector is withdrawn from the printed circuit board, the engagement between the retaining device and the connector is strong enough to resist such withdrawal.

DETAILED DESCRIPTION OF THE PREFERRED EMBODIMENTS

Figure 1:
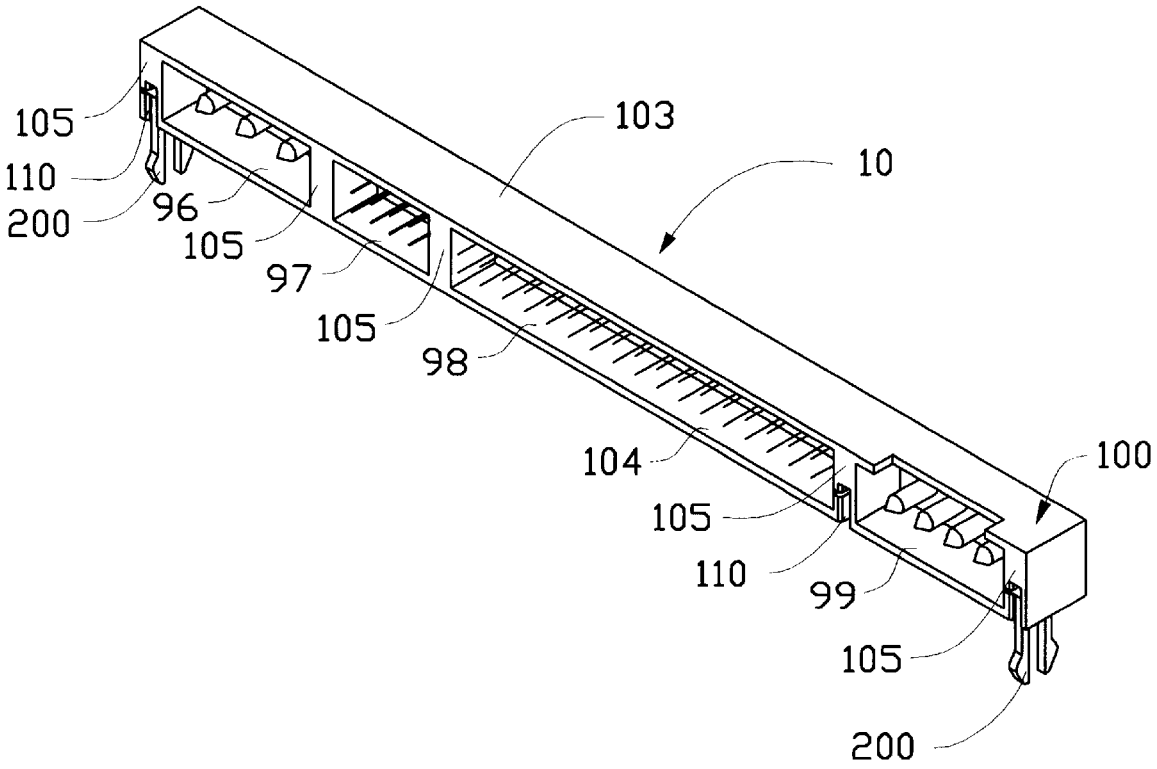
FIG. 1 is a perspective view of a connector in which two retaining device of the present invention is installed.

References will now be described in detail to the preferred embodiments of the invention. While the present invention has been described in reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments.

Referring to the drawings and initially to FIG. 1, a three-in-one connector 10 used at the present time generally includes a body 100 which has several receptacles 96, 97, 98, and 99 defined and separated from each other by a lateral upper wall 103, a lateral bottom wall 104, and several vertical walls 105 10 which connect the lateral upper wall 103 and the lateral bottom wall 104. Three receptacles 110 are respectively defined in the two outermost vertical walls 105 and one of those located between the two outermost vertical wall 105. Each of the receptacles 110 is sized in such a manner that a retaining device 200 (see FIG. 2) in accordance with the present invention is easily engaged and solidly fixed to the receptacle 110.

Figure 3A:
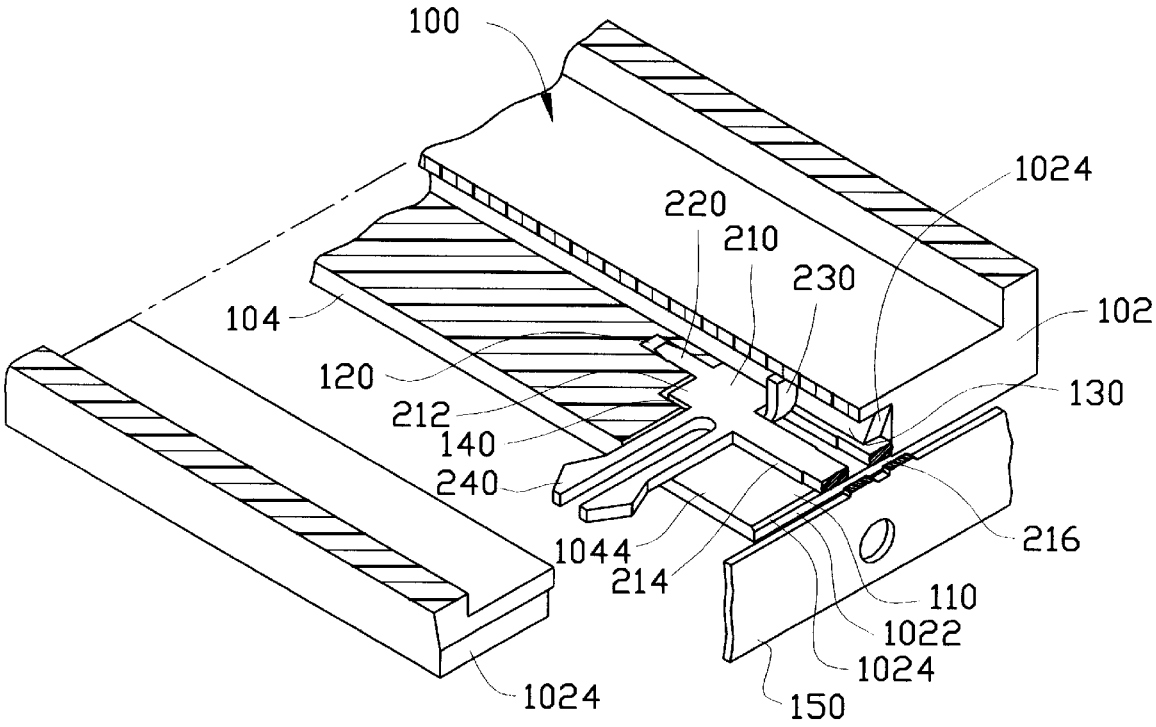
FIG. 3A is an exploded and cross-sectional view of the connector illustrating an engagement relationship of the retaining device adapted thereto, with the reel tape carrier being broken and separated therefrom.
Figure 3B:
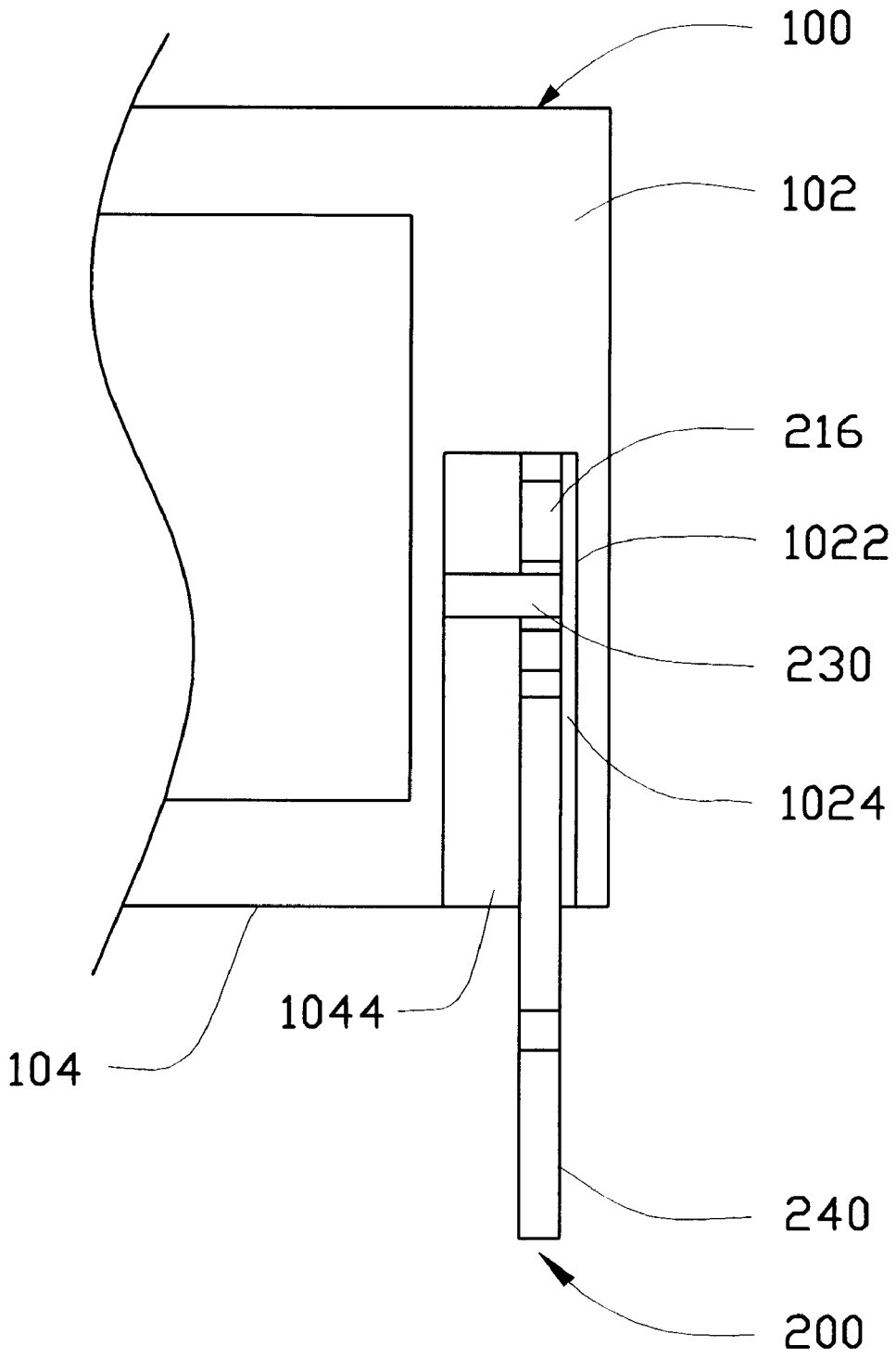
FIG. 3B is a side view of the retaining device firmly received in the connector.

Particularly referring to FIGS. 3A and 3B, the receptacle 110 is defined, according to the function thereof, with a first horizontal window 1022 with a pair of chamfers 1024 by two sides from a rear viewpoint, a second vertical window 1044 from a bottom viewpoint, a guiding slot 130 wherein such slot 130 is formed between two upper and lower planes and one side plane (all not labeled), and an engaging chamber 120. A shoulder 140 is formed adjacent the engaging chamber 120 for fixing the retaining device 200 in a solid manner, which will be explained later. Further, the guiding slot 130 is used to guide the retaining device 200 while the engaging chamber 120 is used to retain the retaining device 200 in place, which will also be explained later.

Figure 2:
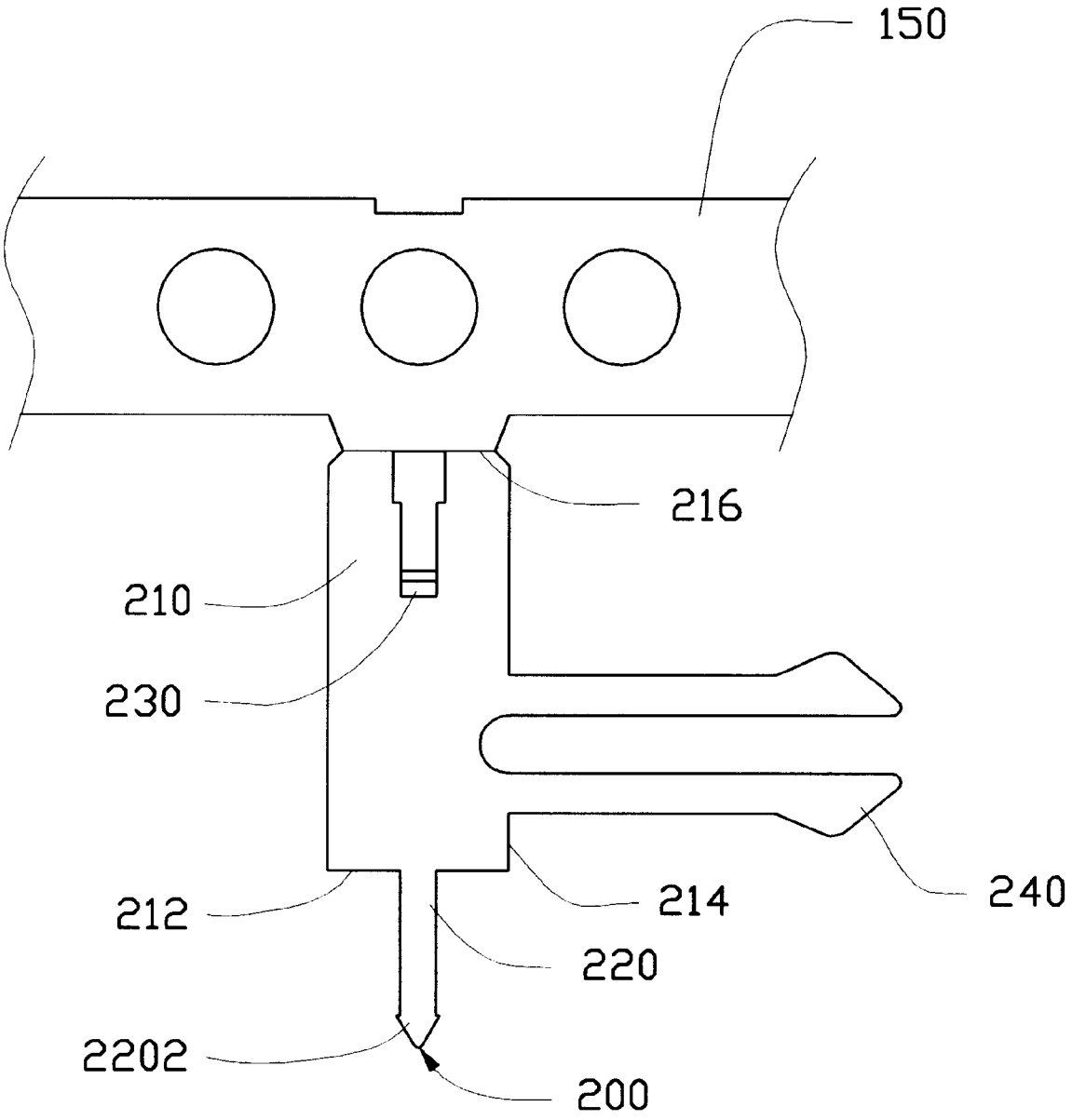
FIG. 2 is a perspective view of a retaining device of the present invention, additionally the retaining device being connected with a reel tape carrier for illustrating the reel tape carrier may be removed from a specific edge of the retaining vice.

Referring to FIGS. 2 and 3A, the retaining device 200 in accordance with the present invention comprises a main body 210 including a first edge 212, a second edge 214, a third edge 216. A male portion or first engaging portion 220 extending from the first edge 212 includes barbs 2202 near one end thereof. A reel tape carrier 150 is connected to the third edge 216 of the main body 210 for illustrating the normal carrier structure of consecutive pieces of the retaining devices 200. The second edge 214 is defined at a lower side of the main body 210 between the first edge 212 and the third edge 216. A hook or second engaging portion 240 for engaging to a printed circuit board (not shown) is extended from the second edge 214. A guiding and positioning portion 230 formed by a punching procedure on the main body 210 is formed between the first edge 212 and the third edge 216. The guiding and positioning portion 230 is substantially perpendicular to a generally plan surface of the main body 210.

Further referring to FIG. 3A, the retaining device 200 is inserted into the receptacle 110 by the guiding and positioning portion 230 from the first window 1022, with the tapering front surface 131 formed to aid the insertion of the retaining device 200 into the receptacle 110. The retaining device 200 is proceeded with the insertion until the male portion 220 is received and fixed in the engaging chamber 120.

After the retaining device 200 is totally inserted into the receptacle 110, the hook 240 protrudes from the second window 1044 of the receptacle 110 and the reel tape carrier 150 is detached by a machine (not shown) in a mass production of assembly.

While the present invention has been described with reference to specific embodiments, the description is illustrative of the invention and is not to be construed as limiting the invention. Actually, the preferred embodiment described above is not to limit the scope of this invention. For example, the guiding and positioning portion 230 and the corresponding guiding slot 130 are not necessarily to be the specific structures as mentioned, which may be manufactured following a guide line that the two are mated with each other. Similarly, the male portion 220 of the retaining device 200 of the present invention is not limited to be a male portion, i.e., the male portion 220 may be changed to be a female portion to be engaged to a corresponding male portion which replaces the engaging chamber 120 defined in the receptacle 110. It should be stressed that the most important spirit of this invention focuses on the purpose that there must be mating structures of the retaining device 200 and the receptacle 110 having strong engagement thereof, and particularly one which can resist the withdrawal of the connector from the printed circuit board. Therefore, Various modifications to the present invention can be made to the preferred embodiments by those skilled in the art without departing from the true spirit and scope of the invention as defined by the appended claims.

Persons of ordinary skill in this field shall understand that all such equivalent structures are to be included within the scope of the following claims.

We claim:

1. A retaining device for fixing a connector on a printed circuit board comprising:

a main body including a first edge and a second edge substantially perpendicular to the first edge;

a first engaging portion extending from the first edge of the main body and firmly fixed in the connector via barbs;

a guiding and positioning portion projecting from and substantially perpendicular to the main body for guiding and positioning the main body in the connector;

a second engaging portion extending from the second edge of the main body and engaging to the printed circuit board.

2. The retaining device as claimed in claim 1, wherein the main body comprises a third edge connected to a reel tape carrier and the reel tape carrier is removed from the third edge when the retaining device is fixed to the connector.

3. The retaining device as claimed in claim 1, wherein the first engaging portion is substantially an elongate body.

4. The retaining device as claimed in claim 1, wherein the guide and positioning portion is located between the first edge and the third edge.

5. A retaining device for fixing a connector on a printed circuit board, wherein the connector comprises a receptacle which defines a guiding slot and an engaging chamber therein, the retaining device comprising:

a main body including a first edge and a second edge substantially perpendicular to the first edge;

a first engaging portion extending from the first edge of the main body and firmly fixed in the engaging chamber of the connector by means of barbs extended from the first engaging portion;

a guiding and positioning portion projecting from and substantially perpendicular to the main body for guiding and positioning the main body via the guiding slot thus easing the main body to be positioned in place in the receptacle; and a second engaging portion extending from the second edge of the main body and engaging to the printed circuit board.

6. The retaining device as claimed in claim 5, wherein the base body comprises a third edge connected to a reel tape carrier and the reel tape carry is removed from the third edge when the retaining device is fixed to the connector.

7. The retaining device as claimed in claim 5, wherein the first engaging portion is substantially an elongate body.

8. The retaining device as claimed in claim 5, wherein the guide and positioning portion is located between the first edge and the third edge.

9. An arrangement for combining a retaining device within a connector, comprising:

a receptacle defined within the connector, said receptacle having an engaging chamber on an innermost portion and a guiding slot; and said retaining device including a generally plate-like main body with a first engaging portion retainably received within said engaging chamber, and a second engaging portion extending downward out the connector for being adapted to engage a PC board on which the connector is mounted; and a guiding and positioning portion extending out of the main body in a lateral direction away from general plane thereof for slidably moving along said slot thereby to providing not only a guiding/positioning function during assembling said retaining device to the connector, but also a reinforcement function to maintain the retaining device in the connector by resisting forces imposed thereon under the situation that the connector with the associated retaining device is withdrawn from said PC board.

* * * * *